US005129409A

United States Patent [19]

White et al.

[11] Patent Number: 5,129,409

[45] Date of Patent: Jul. 14, 1992

[54] EXTRUDED CIGARETTE

[75] Inventors: Jackie L. White, Pfafftown; Lucas J. Conrad; William S. Simmons, both of Winston-Salem, all of N.C.

[73] Assignee: R. J. Reynolds Tobacco Company, Winston-Salem, N.C.

[21] Appl. No.: 373,133

[22] Filed: Jun. 29, 1989

[51] Int. Cl.[5] ..... A24C 5/14; A24C 5/00; A24D 1/00

[52] U.S. Cl. ..... 131/364; 131/360; 131/77; 131/78; 131/84.1

[58] Field of Search ..... 131/364, 360, 361, 362, 131/363, 194, 77, 78, 84.1

[56] References Cited

U.S. PATENT DOCUMENTS

| | | | |
|---|---|---|---|
| Re. 24,424 | 2/1958 | Samfield et al. . | |
| 1,156,609 | 10/1915 | Mewborne . | |
| 2,433,877 | 1/1948 | Wells et al. . | |
| 2,485,670 | 10/1949 | Sowa et al. . | |
| 2,845,933 | 8/1958 | Samfield et al. . | |
| 3,012,562 | 12/1961 | Merritt . | |
| 3,042,553 | 7/1962 | Rosenberg . | |
| 3,085,580 | 4/1963 | Muth . | |
| 3,098,492 | 7/1963 | Wurzburg et al. . | |
| 3,141,462 | 7/1964 | Block et al. . | |
| 3,203,432 | 8/1965 | Green et al. . | |
| 3,223,090 | 12/1965 | Stubel et al. . | |
| 3,364,935 | 1/1968 | Moshy et al. . | |
| 3,404,691 | 10/1968 | Moshy et al. . | |
| 3,410,279 | 11/1968 | Moshy et al. . | |
| 3,467,109 | 9/1969 | Block et al. . | |
| 3,528,434 | 9/1970 | Halter et al. . | |
| 3,760,815 | 9/1973 | Deszyck . | |
| 3,894,544 | 7/1975 | Egri . | |
| 3,931,824 | 1/1976 | Miano et al. . | |
| 3,932,081 | 1/1976 | Buchmann et al. . | |
| 3,968,804 | 7/1976 | Kelly et al. . | |
| 4,027,679 | 6/1977 | Kaswan | 141/363 |
| 4,083,371 | 4/1978 | Beringer et al. . | |
| 4,164,948 | 8/1979 | Beringer et al. . | |
| 4,219,031 | 8/1980 | Rainer et al. | 131/359 |
| 4,333,484 | 6/1982 | Keritsis . | |
| 4,340,072 | 7/1982 | Bolt et al. . | |
| 4,347,855 | 9/1982 | Lanzilloti et al. . | |

(List continued on next page.)

FOREIGN PATENT DOCUMENTS

| | | |
|---|---|---|
| 267250 | 7/1965 | Australia . |
| 282369 | 7/1929 | European Pat. Off. . |
| 909272 | 10/1962 | European Pat. Off. . |
| 1055445 | 1/1967 | European Pat. Off. . |
| 1397923 | 6/1975 | European Pat. Off. . |
| 2064296 | 6/1981 | European Pat. Off. . |
| 0113595 | 7/1984 | European Pat. Off. . |
| 0167370 | 8/1986 | European Pat. Off. . |
| 1167717 | 4/1964 | Fed. Rep. of Germany . |
| 2552504 | 7/1976 | Fed. Rep. of Germany . |
| 143799 | 5/1975 | Netherlands . |
| 275420 | 5/1951 | Switzerland . |

OTHER PUBLICATIONS

International Symposium on Supercritical Fluids, R. Eggers, "On The Situation Of Continuous Extraction Of Solids By Means Of Supercritical Gases" Oct. 17–19, 1988.

*Primary Examiner*—V. Millin

*Attorney, Agent, or Firm*—Grover M. Myers; David G. Conlin

[57] ABSTRACT

Cigarettes which heat but do not burn tobacco are described, preferably having a carbonaceous fuel element extruded around a physically separate aerosol generating means, comprising an aerosol forming material. These cigarettes are capable of producing substantial quantities of aerosol, both initially and over the useful life of the article, without significant thermal degradation of the aerosol former and without the presence of substantial pyrolysis or incomplete combustion products. Preferably, a barrier member is provided to substantially prevent fluid flow between the aerosol generating means and the fuel element. The barrier member is disposable as the cigarette burns back.

Also described are embodiments wherein the aerosol generating means encircles at least a portion of the extruded fuel element.

In addition, apparatus and method for making smoking articles are described.

61 Claims, 4 Drawing Sheets

U.S. PATENT DOCUMENTS 4,391,285 7/1983 Burnett et al. .
4,425,289 1/1984 Lee et al. .
4,448,208 3/1984 Friedrich et al. .
4,506,684 3/1985 Keritsis .
4,510,950 4/1985 Keritsis et al. .
4,516,590 5/1985 Teng .
4,557,057 10/1985 Weiss et al. .
4,578,878 4/1986 Mizuta et al. .
4,598,721 7/1987 Stiller et al. .
4,625,737 12/1986 Keritsis et al. .
4,714,082 12/1987 Banerjee et al. ..... 131/194
4,771,795 9/1988 White et al. ..... 131/335
4,821,749 4/1989 Toft et al. .
4,823,817 4/1989 Luke .
4,874,000 10/1989 Tamol et al. .
4,880,018 11/1989 Graves, Jr. et al. .
4,980,744 9/1976 Cogswell .

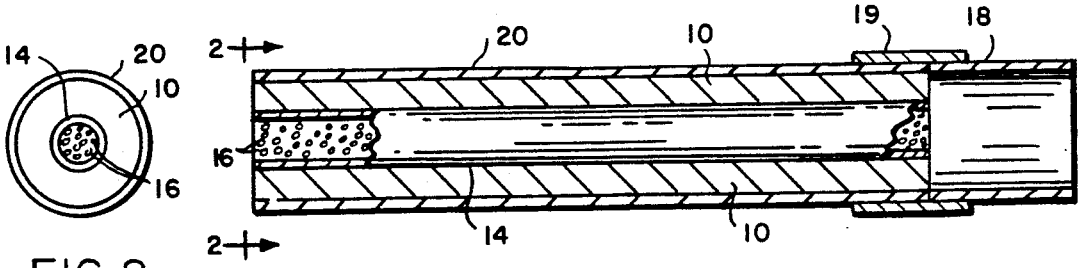
FIG. 2
FIG. 1
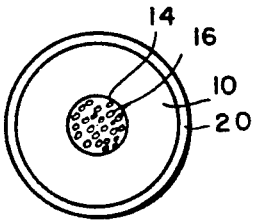
FIG. 3
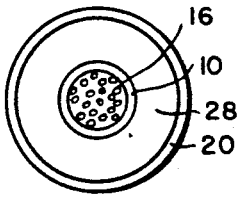
FIG. 4
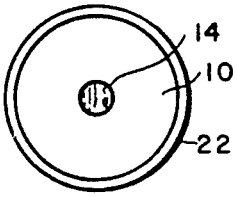
FIG. 5
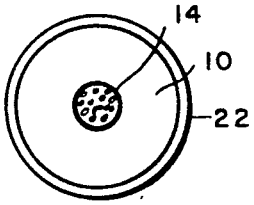
FIG. 6
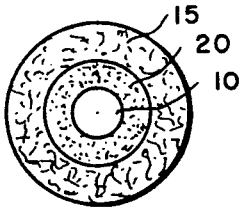
FIG. 7
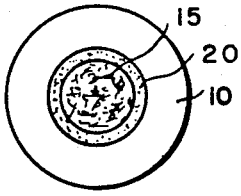
FIG. 8
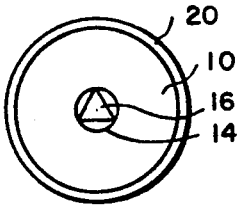
FIG. 9
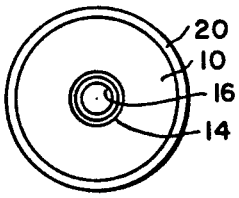
FIG. 10
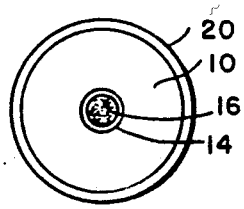
FIG. 11

EXTRUDED CIGARETTE

BACKGROUND OF THE INVENTION

The present invention is directed to extruded smoking articles such as cigarettes and to methods for making such smoking articles. The extruded cigarettes of the present invention burn back as they are smoked, but do not involve the burning of tobacco. They heat the tobacco without burning it.

Cigarettes, cigars and pipes are popular forms of tobacco smoking articles. Many smoking products and smoking articles have been proposed through the years as improvements upon, or as alternatives to, these popular forms of tobacco smoking articles. Examples of improved smoking articles are the cigarettes and pipes described in U.S. Pat. Nos. 4,793,365, 4,771,795, 4,756,318, 4,714,082, and 4,708,151, which generally comprise a fuel element, a physically separate aerosol generating means, and a separate mouthend piece.

Tobacco substitute smoking materials have likewise been proposed as alternatives to tobacco. See, e.g., U.S. Pat. No. 4,079,742 to Rainer et al.

In U.S. Pat. No. 3,258,015, Ellis et al., proposed a smoking article which had an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with air which entered the open end of the tube.

In U.S. Pat. No. 3,356,094, Ellis et al. modified their original design to eliminate the protruding metal tube. This design employed a tube made out of a material which became frangible upon heating, such as certain inorganic salts or an epoxy bonded ceramic. This frangible tube was removed when the smoker eliminated ash from the end of the article. Apparently no commercial product corresponding to either of the Ellis et al patents was ever marketed.

In British Patent No. 1,185,887, particularly in FIGS. 3 and 6, Ellis-like smoking articles are described comprising a fuel rod enclosed within a tubular casing, and having an axially disposed inner tube which contains an inhalable material. The inner tube was designed to disintegrate and be eliminated with the ash during burning.

Other more recent smoking articles, such as described in Sensabaugh (U.S. Pat. No. 4,793,365) involve a substantially different concept having a physically separate aerosol generating means which is longitudinally adjacent to a fuel element. Such smoking articles do not burn back substantially as the article is smoked.

U.S. Pat. No. 4,771,795 describes an elongated, cigarette-type smoking article which utilizes a dual burn rate carbonaceous fuel element that preferentially circumscribes a physically separate axially extending aerosol generating means. A metallic tube serves as the preferred container for the aerosol generating means. Generally, the tube extends from one end of the fuel element to the other, with openings at both ends.

SUMMARY OF THE INVENTION

The present invention is directed to extruded cigarettes having a fuel element and a physically separate aerosol generating means. The invention is also directed to a process and means for the formation of an extruded cigarette which is capable of producing substantial quantities of aerosol, both initially and over the useful life of the article, without significant thermal degradation of the aerosol former and without the presence of substantial pyrolysis or incomplete combustion products.

Preferred cigarettes prepared in accordance with the present invention are capable of providing the user with the pleasures of smoking (e.g. smoke taste, feel, aroma, satisfaction, and the like) by heating without burning tobacco.

Preferred cigarettes of the present invention burn back as they are smoked and comprise an annular carbonaceous fuel segment, a physically separate aerosol generating means disposed concentrically within said fuel segment, a barrier member between the fuel segment and the aerosol generating means, which substantially precludes fluid flow radially therethrough, and which is disposable as the cigaratte is smoked, and a mouthend segment.

In one preferred embodiment of the invention, these and other advantages are obtained by forming an elongated, cigarette shaped article which utilizes an extruded carbonaceous fuel element which circumscribes a physically separate axially extending extruded aerosol generating means.

In general, a process for preparing preferred cigarettes of the present invention comprises the following steps:

(a) forming a cylindrical aerosol generating means comprising a heat stable substrate material and at least one aerosol forming substance; the aerosol generating means being circumscribed by a barrier member that permits air and aerosol to flow longitudinally, but not radially, therethrough; and (b) forming around at least a portion of the barrier member sufficient carbonaceous fuel to provide adequate heat for the generation of an aerosol during the burning thereof.

In addition to the above steps, a further step, which entails forming an insulating member around the periphery of the fuel element, can be added for preferred embodiments. Other steps can also be added and alternatives can be used.

In one preferred embodiment, a method of making smoking articles in accord with this invention comprises depositing on a wrapper a substrate comprising an aerosol generating composition that simulates the taste and aroma of tobacco smoke, folding the wrapper circumferentially about the substrate, extruding a layer comprising carbonaceous material about the wrapped substrate, drying the layer to form a carbonaceous fuel element, extruding a layer of insulative material about the layer of carbonaceous material, and wrapping the composite structure with a conventional paper wrapper. Preferably, the substrate is extruded in the form of a rod containing at least one passage longitudinally thereof and is comprised of a mixture of bentonite and glycerine. The substrate may be at least partially dried prior to the extrusion of the carbonaceous material layer. The material that forms the fuel preferably comprises a paste of carbon, binder and water. The insulative material comprises a paste of diatomaceous material preferably in a binder. One method includes depositing the rod containing aerosol generating substrate on the wrapper, advancing the rod and wrapper continuously through a folding device for folding the wrapper about the rod, applying adhesive to an edge of the wrapper as the edges of the wrapper are brought into engagement by the folding device, moving the wrapped rod through an extruding device for extruding the layer of carbon paste about the wrapped rod, drying the carbon paste to form a carbonaceous fuel layer, moving the wrapped rod coated with the carbonaceous fuel layer through an extruding device for extruding the layer of diatomaceous paste about the layer of carbon paste, drying the diatomaceous paste, and wrapping the same with paper.

In another embodiment, the method of making smoking articles in accord with the present invention comprises depositing a layer of particulate aerosol generating composition on an adhesive-coated surface of the wrapper, forming the wrapper to which the layer of adhesive and the aerosol generating composition have been applied into a tube, extruding a layer of carbon paste about the tube, extruding a layer of insulative paste about the layer of carbon paste, drying the layers of carbon paste and insulative paste, and wrapping the composite structure with a paper wrapper.

The methods preferably include monitoring the extruded layers of carbon paste and insulative paste and adjusting the extruders to obtain layers of predetermined uniform thickness.

During smoking, heat from the burning fuel element is rapidly transferred to the aerosol generating means in the cigarettes of this invention and this heat causes the volatilization of the aerosol forming material contained therein, which in turn is produces to the user a "smoke-like" aerosol through the mouth end of the article. Due to the preferred configurations of the elements in the extruded cigarettes of the present invention, little or none of the fuel combustion products are drawn into the aerosol produced to the user.

In addition to the aforementioned benefits, preferred cigarettes of the present invention are capable of providing an aerosol which is chemically simple, consisting essentially of air, oxides of carbon, water, aerosol former including any desired flavors or other desired volatile materials, and trace amounts of other materials. This aerosol preferably has no tobacco pyrolysis products and has little or no significant mutagenic activity as measured by the Ames Test.

Preferred cigarettes in accord with the present invention produce smoke having very low levels of carbon monoxide, preferably less than about 10 mg total CO over the life of the smoking article, more preferably less than about 5 mg total CO, most preferably less than about 3 mg total CO.

As used herein, and only for the purposes of this application, "aerosol" is defined to include vapors, gases, particles, and the like, both visible and invisible, and especially those components perceived by the user to be "smoke-like," generated by action of the heat from the burning fuel element upon substances contained within the aerosol generating means, or elsewhere in the article. As so defined, the term "aerosol" also includes volatile flavoring agents and/or other volatile agents, regardless of whether they produce a visible aerosol.

As used herein, "carbonaceous" refers to the use of at least 50 percent carbon in the solid material content of the fuel element or paste used to make it. As used herein, "frangible" refers to a material which decomposes, is brittle, becomes brittle, or otherwise becomes easily breakable during smoking so as to confer disposability in a manner like ashes are normally eliminated from cigarettes. Preferably, the material becomes frangible upon exposure to heat during smoking.

BRIEF DESCRIPTION OF THE DRAWINGS

FIG. 1 is a longitudinal sectional view illustrating one embodiment of a cigarette prepared in accord with the teachings of the present invention.

FIG. 2 is an end view along line 2—2 of FIG. 1.

FIG. 3 through 11 are end views of alternative embodiments of cigarettes prepared in accord with the teachings of the present invention.

DETAILED DESCRIPTION OF THE PREFERRED EMBODIMENTS

Figure 12:
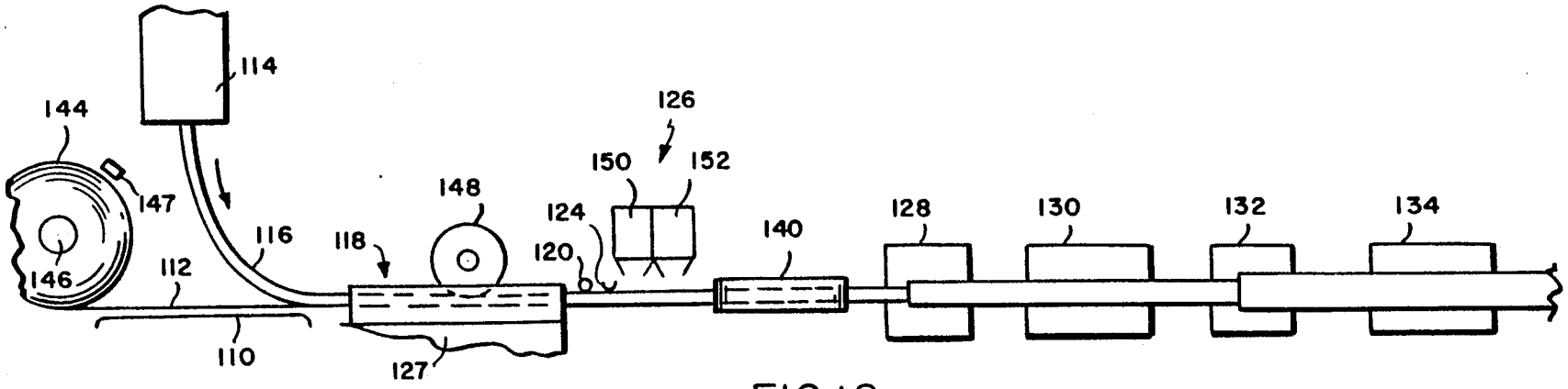
FIG. 12 diagrammatically illustrates in side elevation an apparatus for making smoking articles according to this invention.

In the drawings accompanying this specification there are shown several embodiments of cigarettes in accord with the present invention. The cigarettes illustrated typically comprise a cylindrical member having a traditional size and shape, i.e., about 7–8 mm in diameter and about 78 mm in length. However, smoking articles having other dimensions can readily be made.

Referring now in detail to the drawings, the illustrated embodiments of the present cigarette (as shown in FIG. 1) typically have a fuel element 10, a physically separate aerosol generating means which comprises a substrate 16 bearing an aerosol forming means, a barrier member 14, and a mouthend piece 18. Preferably, the aerosol forming means comprises tobacco or a tobacco material such as cut filler, reconstituted tobacco, puffed tobacco, tobacco paper, extruded tobacco, a tobacco aroma oil, a tobacco essence, a spray dried tobacco extract, a freeze dried tobacco extract, tobacco dust, or the like, or a combination thereof, in order to provide tobacco flavor.

Preferably, the aerosol generating means extends longitudinally in the cigarette, and centrally thereof, in a heat exchange relationship with the fuel element 10. As illustrated, the aerosol generating means extends from at or near the outer or ignition end 9 of fuel element 10 to a point adjacent the end of the mouth end piece 18. If tobacco or other combustible material is used as a substrate or aerosol forming means, recessing of the aerosol generating means from the lighting end of the cigarette can be used to avoid combustion of the tobacco or other material.

The periphery of the above described components of the cigarette is preferably surrounded by an insulating layer 20 which can be a fibrous insulation material, or the like, or preferably is an extruded mixture of diatomaceous earth and a binder, e.g., sodium carboxymethylcellulose (hereinafter sometimes referred to as "CMC" or "NaCMC").

The mouthend piece may comprise a section of non-conductive tubing, e.g., a tubular member made of wood or plastic having a low heat conductivity, e.g. polyethylene, polypropylene, cellulose acetate, etc. The mouthend piece is, preferably provided with a tipping paper (not illustrated) which extends circumferentially around the periphery of the mouthend piece. Joining the mouthend piece to the body of the cigarette is an overwrap 19, which provides a burn barrier.

In preferred cigarettes of the present invention, the fuel element is a carbonaceous material, comprising at least about 50 weight percent elemental carbon. The fuel element is generally extruded or molded in the form of an annular least about 25 mm in length, preferably at least about 40 mm in length, and most preferably from 50 to 60 mm in length, prior to smoking. The annular fuel element preferably has an inner diameter of from about 1.5 mm to 3.5 mm, and an outer diameter of from about 3.5 mm to 7.1 mm.

The carbonaceous fuel element of the present invention is typically prepared from a fibrous cellulosic material by pyrolysis at from about 400° to 900° C., preferably from about 550° to 750° C., in a non-oxidizing atmosphere.

The pyrolyzed material is chopped into short fiber lengths, mixed with a binder and water, and then formed into an annular tube. In preferred embodiments, the annular fuel element is extruded concentrically about the container for the aerosol generating means.

In preferred embodiments, the fuel element is prepared from cotton fibers, preferably cotton linters, which are carbonized in an inert atmosphere at a temperature of about 650° C. The pyrolyzed fibers are then chopped into short fiber lengths, mixed with water and sodium carboxymethylcellulose binder, and shaped, preferably by extrusion, into a fuel element.

The carbon for this fuel element can be made from any vegetable fibers which consist primarily of cellulosic materials. Cotton linters are preferentially used herein. However, other fibers such as, for example, kapok can also be used. It is preferred to use mixing and forming techniques which maximize the fiber length and create an open structure in the finished fuel element.

The central cavity of the annular fuel element preferably contacts and surrounds a barrier member or container which includes the aerosol generating means. As described above, a tubular container is typically employed herein for retaining the aerosol generating means and separating it from the annular fuel element. This container may be formed from any convenient material, e.g., metal (stainless steel, aluminum, copper, etc.), but is preferably made of a burnable or otherwise frangible material, e.g. clays, ceramics, and the like, or paper treated with one or more burn retarding substances.

Barrier member 14 divides the interior of the cigarette into two spaces or regions, i.e., the space inside the tube and the annular space between the tube and the insulating layer 20. In the first of these spaces there is disposed the aerosol generating means which preferably includes the heat stable substrate 16 and at least one volatile aerosol forming material. The other space defined by barrier member 14 and layer 20 contains the fuel element 10.

However, cigarettes of the invention can also be constructed having the fuel element within the barrier member and having the aerosol generating means encircling the barrier member (see FIG. 7).

The barrier member 14 is open at both ends so that an outside air stream and aerosol forming materials can be drawn therethrough. Preferably, the barrier member substantially precludes radial fluid flow.

In the most preferred embodiments, the container for the aerosol generating means is a paper tube, treated with one or more burn retarding compounds to decrease its burn rate. Burn retarding compounds are well known to those skilled in the art and they include colloidal silica, inorganic salts, e.g., sodium chloride, potassium chloride, and the like. A preferred burn retarding compound for use herein is Nya Col 830 colloidal silica.

Generally, the container extends from one end of the fuel element to the other, with openings at both ends. This end to end placement avoids the introduction of significant amounts of fuel combustion gases into the mainstream aerosol which would otherwise be provided to the user.

If desired, the container may be recessed from the lighting end of the fuel, e.g., by about 2 to 5 mm, thereby allowing the introduction of a small amount of fuel combustion gases into the mainstream aerosol during early puffs. Depending upon the material used to form the container, such a recessed placement may also assist in the lighting of the article.

When cold, the container should have adequate strength to resist shocks encountered in manufacturing and handling. In the course of the smoking of the present cigarette however, as the combustion zone of the smoldering fuel travels from the ignition end toward the mouthend piece, the material forming the container preferably burns or otherwise is destructively affected so that the end portion of the container will not project beyond the smoldering fuel and so that it can be readily discarded with any ash from the fuel element and/or the insulating layer. The preferred paper container of the present invention satisfies this requirement quite readily.

The aerosol generating means preferably comprises a heat stable substrate and at least one aerosol forming material. As used herein, the term "heat stable" refers to any material which is not decomposed upon exposure to the heat generated by the burning fuel element of the cigarette. A substrate material may become brittle, friable, or otherwise frangible upon exposure to the heat from the burning fuel element and still be considered heat stable in the present usage.

The substrate may be in solid form or in particulate form, but is preferably in powdered form, for ease of extrusion. The substrate may be selected from materials such as graphite fibers, glass fibers, alumina pellets, aluminum mesh wire, porous adsorbents or absorbents such as carbon, silica, clays, and the like. The substrate is preferably heat stable as used in the smoking article.

The aerosol forming substance or substances used in the cigarettes of the present invention must be capable of forming an aerosol at the temperatures present in the aerosol generating means upon heating by the burning fuel element.

Substances having these characteristics include: polyhydric alcohols, such as glycerin, triacetin triethylene glycol, and propylene glycol, as well as aliphatic esters of mono-, di-, or poly-carboxylic acids, such as methyl stearate, dimethyl dodecandioate, dimethyl tetradecandioate, and the like.

The preferred aerosol forming substances are polyhydric alcohols, or mixtures of polyhydric alcohols. Most preferred aerosol formers are selected from glycerin, triethylene glycol and propylene glycol.

The aerosol generating means also may include one or more volatile flavoring agents, such as menthol, vanillin, chocolate, licorice, artificial coffee, tobacco extracts, tobacco flavor modifiers such as levulinic acid, caffeine, liquors, and other agents which impart flavor to the aerosol, or combinations thereof. It also may include any other desirable volatile solid or liquid materials. Alternatively, these optional agents may be placed between the aerosol generating means and the mouthend piece, such as in a separate substrate or chamber.

When a substrate material is employed as a carrier, the aerosol forming substance may be dispersed on or within the substrate in a concentration sufficient to permeate or coat the material, by any known technique.

It has been discovered that certain substrate materials such as alumina, bauxite, carbon, etc. have a small pore size, e.g. on the order of a few hundred angstroms and that these substrates allow the aerosol generating and flavor materials to be released very slowly. This has been evidenced by the discovery of black (carbonized centers) in alumina pellets which had been subjected to machine smoking conditions. Such conditions may permit for the formation of undesirable decomposition products and/or increased generation of carbon monoxide. In order to provide larger pore size substrate materials, aluminum metal mesh and sheets have been used for the formation of substrates. Substrates that minimize decomposition of the aerosol forming means are preferred.

It has been discovered that bentonite and glycerin or propylene glycol can be mixed to form a very viscous paste, and that this paste can be extruded into various shapes that will function as an aerosol generator when sufficient heat is applied. Tobacco extracts may be added to the bentonite and glycerin or propylene glycol mixture to provide taste and aroma to the aerosol generated.

The currently preferred substrate material and aerosol forming substance is prepared from an admixture of bentonite clay, glycerine, and any desired optional flavoring agents (e.g. tobacco extracts, etc.). This mixture forms a viscous paste which can be molded or extruded into a rod, overwrapped with the preferred treated paper forming the container for the aerosol generating means, and this combination can then be overcoated by molding or extrusion of the preferred fuel element composition.

In certain preferred embodiments, the entire periphery of the fuel element is surrounded by an insulating member which, in addition to directing the heat of the burning fuel toward the aerosol generating means, helps bring the outer diameter of the article up to that of a standard tobacco cigarette, e.g., to from about 7.5 to 8.0 mm. The presence of such an insulating member aids in directing the heat from the burning fuel element to the aerosol generating means. The insulating member also serves to reduce risk of fire caused by the article.

Conventional insulating materials such as glass fibers, clays, and the like may be employed herein. Preferred insulating members are generally at least about 0.5 mm, preferably about 1.0 mm thick. Preferably, the material is frangible or becomes frangible on heating and is eliminated with the ash as the article burns back. One especially preferred insulating member for the cigarette of the present invention comprises a paste of diatomaceous earth and a binder such as sodium carboxymethylcellulose (sometimes referred to as "NaCMC" or "CMC"), which is coated, molded or extruded onto the outermost periphery of the carbon fuel. Insulating members of this type may also include short lengths of fiber (e.g. glass) for added stability.

As used herein, the term "insulating member" applies to all materials which act primarily as insulators. Preferably, these materials do not burn during use, but they may fuse during use, such as low temperature grades of glass fibers. Suitable insulators have a thermal conductivity in g-cal/(sec) ($cm^2$)(°C./cm), of less than about 0.05, preferably less than about 0.02, most preferably less than about 0.005. See, Hackh's Chemical Dictionary, 34, 4th ed., 1969 and Lange's Handbook of Chemistry, 10, 272–274 11th ed., 1973.

The mouthend piece of the articles of this invention typically consist of suitable material which preferably does not conduct heat, for instance, a hollow plastic or wooden tube, a section of tobacco rod, cigarette filter material, or any combination of these elements. The preferred nonconductive nature of the mouthend piece is to prevent high heat transfer to the smoker's mouth or lips.

The mouthend piece can also be a low efficiency filter made from a melt blown thermoplastic such as polypropylene. For example, the filter can be manufactured by pleating a web of nonwoven polypropylene available from Kimberly-Clark Corp. as experimental melt blown, macrofiber polypropylene PP-100-F. Alternatively, the mouthend piece can be manufactured from cellulose acetate tow, or the like. Preferably, the filter material is overwrapped with a paper plug wrap.

The cigarettes of the present invention can also include a tobacco plug spacer member positioned between the aerosol generating means and the mouthend piece. The plug spacer member conveniently permits passage of aerosol therethrough. It can be a cylindrical plug of tobacco, or of pleated tobacco paper (e.g., Kimberly-Clark Corp. P144-185-GAPF Reconstituted Tobacco Sheet), or the like. Preferably, the plug spacer member is overwrapped with paper.

The front end of the cigarettes of the present invention comprising the extruded fuel element, insulating and aerosol generating means is preferably joined to the mouthend piece by a paper wrapper that functions as a burn barrier 19. The burn barrier may be, for example, Kimberly Clark's P1224-30-2 paper.

The entire length of the cigarette, or any portion thereof, may be overwrapped with one or more layers of cigarette paper. Preferred papers should not openly flame during burning of the fuel element. In addition, the paper should have controllable smolder properties and should produce a grey, cigarette-like ash.

To reduce the burning rate and temperature of the fuel element, thereby maintaining a low $CO/CO_2$ ratio, a non-porous or zero-permeability paper which may optionally be treated to be slightly porous, e.g., noncombustible mica paper with a plurality of holes therein, may be employed as the overwrap layer. Zero permeability paper may also serve as a burn prevention wrapper, extinguishing the fuel element at the mouthend by preventing oxygen from reaching the fuel.

Low permeability papers are known in the cigarette and/or paper arts. Mixtures of such papers may be employed for various functional effects. Preferred papers used in the cigarettes of the present invention include Kimberly Clark's (KC) P 1224-30-2, P 1768-83-2A, P 780-63-5, AT-N, P 1487-31, P 850-162, P 878-16-2, and 850-163 papers as well as RJR Archer's (Archer) 8-0551-93 and 5522 papers.

Preferred embodiments of this invention are capable of producing to the smoker at least 0.6 mg of aerosol, measured as wet total particulate matter (WTPM), in the first 3 puffs, when smoked under FTC smoking conditions, which consist of a 35 ml puff volume of two seconds duration, separated by 58 seconds of smolder. More preferably, embodiments of the invention are capable of producing 1.5 mg or more of aerosol in the first 3 puffs. Most preferably, embodiments of the invention are capable of producing 3.0 mg or more of aerosol in the first 3 puffs when smoked under FTC smoking conditions. Moreover, preferred embodiments of the invention produce an average of at least about 0.8 mg of WTPM per puff for at least about 6 puffs, preferably at least about 10 puffs, under FTC smoking conditions. More preferably, preferred embodiments produce 20 to 30 mg, or more, of WTPM over at least 10 puffs, under FTC smoking conditions.

The aerosol produced by the preferred cigarettes of the present invention (measured as wet total particulate matter, or WTPM) is chemically simple, consisting essentially of air, water, oxides of carbon, the aerosol former, any desired flavors or other desired volatile materials, and trace amounts of other materials. The aerosol produced by the preferred cigarettes of the present invention preferably contain very little carbon monoxide.

The WTPM produced by the preferred cigarettes of this invention preferably has little or no measurable mutagenic activity as measured by the Ames test, i.e., preferably there is little or no significant dose response relationship between the WTPM produced by preferred cigarettes of the present invention and the number of revertants occurring in standard test microorganisms exposed to such products. According to the proponents of the Ames test, a significant dose dependent response indicates the presence of mutagenic materials in the products tested. See Ames et al., Mut. Res., 31: 347-364 (1975); Nagao et al., Mut. Res., 42: 335 (1977).

Smoking articles in accord with the present invention may be used or may be modified to produce various volatile ingredients to the smoker.

FIG. 1 and FIG. 2 illustrate one embodiment of a cigarette in accord with the present invention. A tubular barrier member 14 contains alumina particles 16 carrying glycerine. The tubular barrier member 14 is made of a flexible material folded around the particles to prevent radial fluid flow, and is encircled by a carbonaceous fuel element 10 along its longitudinal length. The fuel element is in turn encircled by an insulating member 20 along its longitudinal length. This portion is joined to mouthend piece 18 with a burn barrier overwrap 29.

FIG. 3 illustrates an alternative embodiment of a cigarette in accord with the present invention wherein the radial dimensions of the tubular barrier member 14, the fuel element 10, and the insulating member 20 are changed.

FIG. 4 illustrates an alternative embodiment of a cigarette in accord with the present invention wherein there is provided an intermediate or inner insulating member 28 between the fuel element 10 and the insulating member 20.

FIG. 5 and FIG. 6 illustrate alternative embodiments of a cigarette in accord with the present invention wherein the fuel element 10 contains insulation material. The insulating fuel member encircles an aerosol generating module 14 along its entire length. The fuel member in turn is overwrapped with an outside paper 22.

FIG. 7 illustrates an alternative embodiment of the invention wherein the fuel element 10 is an extruded carbonaceous material having a slow burning rate. The fuel element is encircled along its longitudinal length by an insulation member 20. The insulation member is in turn encircled along its length by tobacco 15. The burning rate of the fuel element and the insulation are such that the tobacco is not heated above 500° C., preferably not above about 250° to 400° C., under standard smoking conditions. The insulation can provide the tubular barrier member between the tobacco material and the fuel element or an additional tubular barrier member such as an appropriately treated paper tube can be used.

Standard smoking conditions, as used herein, refer to either the FTC smoking conditions described hereinabove or smoking under conditions wherein 50 ml puff volume is drawn in one second followed by 30 seconds of smolder.

FIG. 8 illustrates an alternative embodiment of a cigarette in accord with the present invention wherein a rod of tobacco 15 or tobacco material is encircled along its longitudinal length by an insulating member 20. The insulating member is is turn encircled by a carbonaceous fuel member 10, preferably formed of carbon fibers having a low burning rate. Once again, the burning rate and the insulation effect are such that the tobacco is not heated above 500° C., preferably not above about 250° C. to 400° C., under standard smoking conditions.

FIG. 9 illustrates an alternative embodiment of a cigarette in accord with the present invention wherein an aerosol generating substrate in the form of a triangular extruded rod 16 is encircled by a tubular barrier member 14. The tubular member is encircled along its length by an extruded carbonaceous fuel element 10, which is in turn encircled by an insulation member 20.

FIG. 10 illustrates an alternative embodiment of a cigarette in accord with the present invention wherein an aerosol generating substrate in the form of an extruded tubular rod 16 is encircled by a tubular barrier member 14. The barrier member is encircled along its length by an extruded carbonaceous fuel element 10, which is in turn encircled along its length by an insulating member 20.

FIG. 11 illustrates another alternative embodiment of a cigarette in accord with the present invention wherein an aerosol generating substrate 16 is encircled by a tubular barrier member 14. the tubular barrier member is encircled along its length by an extruded carbonaceous fuel element 10, which in turn is encircled along its length by an extruded insulating member 20.

The embodiments illustrates in FIG. 1 through 11 are further described in the Examples.

Figure 13:
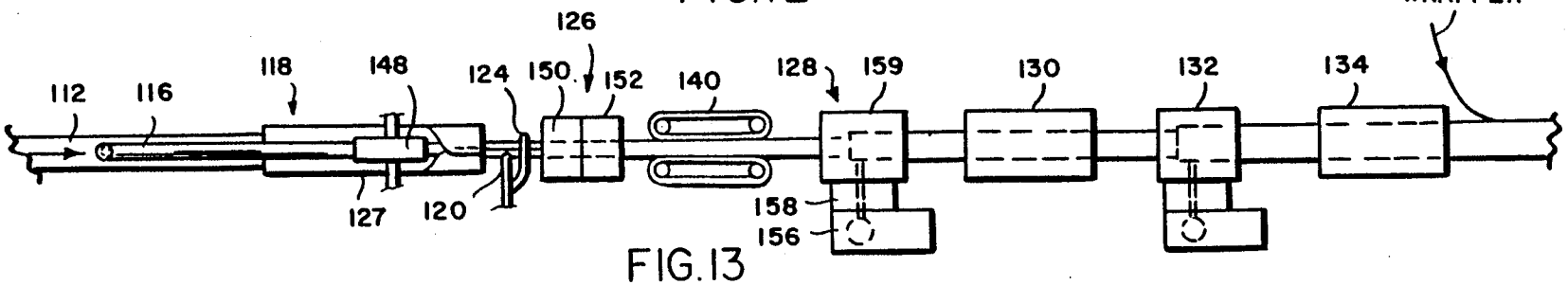
FIG. 13 diagrammatically illustrates the apparatus for making smoking articles according to this invention in plan view.

One embodiment of an apparatus for making extruded cigarettes as herein described is illustrated in FIGS. 12 and 13. The apparatus comprises means 110 for guiding a narrow wrapper strip 112 along a predetermined horizontal path, means 114 for depositing a substrate 116 of aerosol generating composition on the wrapper strip, a folding device 118 for folding the wrapper strip about the substrate 116, means 120 for applying an adhesive to one of the marginal edges of the wrapper strip as the strip leaves the folding device, means 124 for pressing the adhesive-coated edge into engagement with the other edge of the strip, means 126 for drying or curing the adhesive to seal the edges to each other, means 128 for extruding a layer of carbon paste 119 about the wrapped substrate, means 130 for drying the layer comprising the carbon paste, means 132 for extruding a layer of insulative paste 121 about the partially-dried layer of carbon paste and means 134 for drying the layer of insulative paste. Beyond the drying means 134, there are means, not shown, for applying a wrapper strip 123 to the composite structure. Such means can be any conventional machine used for applying a wrapper to conventional cigarettes.

Conveyor means 140 is provided for moving the wrapped substrate 116 rectilinearly through the apparatus. At the discharge end of the apparatus, additional conveyor means (not shown) are provided to draw the wrapped continuous product from the apparatus and there are means (not shown) for cutting the composite structure into appropriate lengths.

The wrapper strip 112 is drawn from a coil 144, FIG. 12, of paper supported on a horizontal spindle 146 for unwinding. A brake finger 147 bearing against the coil 144 prevents free rotation of the coil and provides for maintaining tension in the strip as it is advanced.

Figure 14:
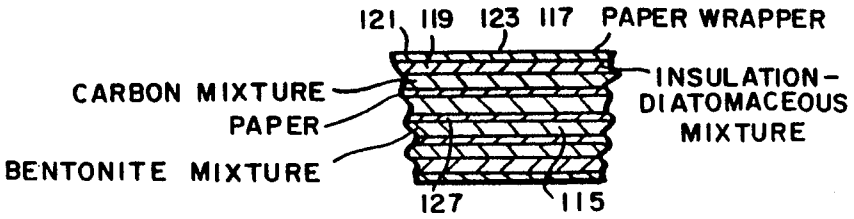
FIG. 14 is a fragmentary section through a smoking article made according to this invention.
Figure 16:
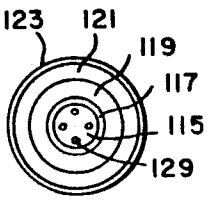
FIG. 16 is an end view of a modified smoking article wherein the core piece contains a plurality of longitudinal passages.
Figure 15:
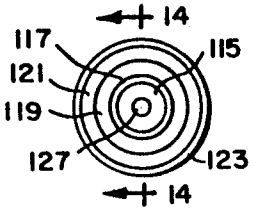
FIG. 15 is an end view of the smoking article shown in FIG. 14.

The folding device or garniture 118, as illustrated, comprises an elongate structure 127 of channel-shaped section of a width to receive the wrapper strip 112 at its entrance end and to fold the opposite longitudinal edges upwardly toward each other about the substrate 116. The means 114 for depositing the substrate 116 on the wrapper strip 112 is supported above the folding device 118 and comprises an extruder for extruding the substrate onto the wrapper strip as the latter enters the folding device 118. Extruder 114 comprises a slurry pump (e.g. such as sold under the name Moyno) for pumping a slurry of aerosol containing substrate, preferably comprising a bentonite paste, and a die to form the slurry into the desired cylindrical shape for the bentonite/aerosol containing material, the shape having one or more longitudinal holes 127, 129 as illustrated in FIGS. 14, 15, and 16.

The extruder device 114 guides the substrate onto the surface of the wrapper as the wrapper enters the folding device 118. A disk 148 containing a half-circular groove peripherally thereof provides for pressing the substrate into engagement with the wrapper 112 as the latter is advanced through the folding device. The folding device 118 wraps the opposite longitudinal edges of the wrapper strip upwardly about the substrate folding one longitudinal edge into contact with the substrate and disk 148 folds one longitudinal edge into contact with the substrate. As the partially-folded wrapper strip with the substrate resting thereon emerges from the folding device, adhesive is marginally applied to the underside of the other longitudinal edge of the wrapper strip by means 120 which is in the form of a nozzle supported adjacent the folding device. A finger 124 mounted to the adhesive nozzle 120 transversely of the path of movement of the partially-wrapped substrate presses the opposite edges of the wrapper strip into lapping engagement with the adhesive between the lapped edges.

The means 126 for drying and/or curing the lapped edges of the wrapper strip about the substrate comprises heating means 150 followed by cooling means 152 supported adjacent the path of movement of the wrapped substrate.

Figure 18:
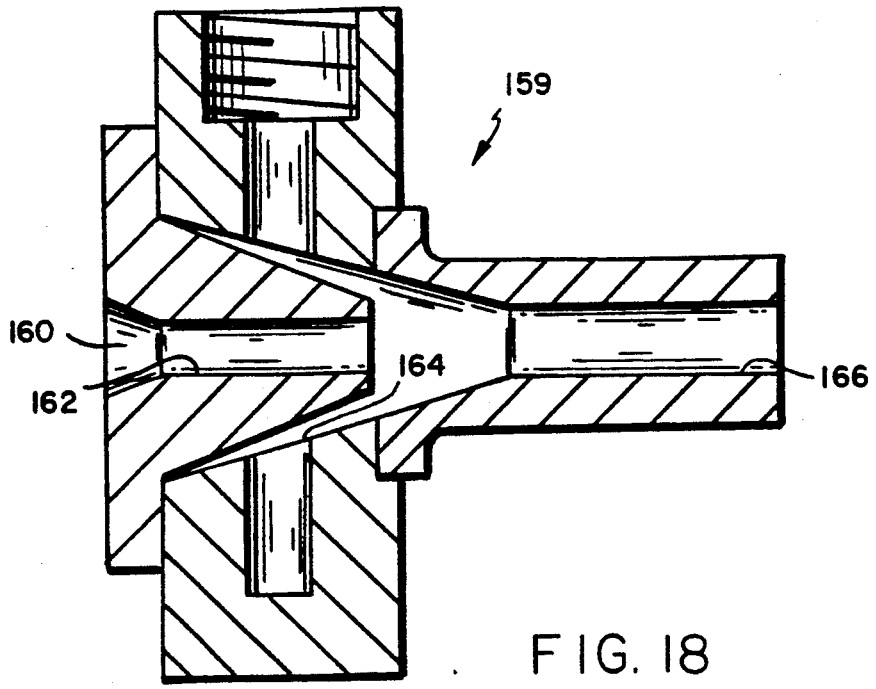
FIG. 18 is an enlarged longitudinal section of an extrusion nozzle for extruding a carbon layer or an insulative layer.

The extruder 128, FIGS. 12 and 18, for extruding the carbon paste about the wrapped tube comprises a slurry pump 156 for conveying a slurry of carbon paste and a manifold for delivering the mixture from the pump to the die 159 for extrusion of the carbon paste about the wrapped substrate. The die 159, FIG. 18, embodies a through passage 160 comprising a first portion 162 corresponding in diameter to the wrapped substrate, an annular portion 164 concentric with the passage 162 into which the carbon paste is injected and from which it is formed concentrically about the paper-wrapped substrate as the latter leaves the passage 162 thereby forming a layer of carbon paste about the wrapped substrate and a passage 166 for controlling the thickness of the layer of carbon paste. The entrance to the passage 162 is conical, the annular passage 164 is conical and the entrance to the passage 166 is conical.

The means 130 and 134 for drying the layer of carbon paste and the layer of insulative paste may comprise a plurality of heat lamps, not shown, supported adjacent the path of movement or, alternatively, an elongate heating coil, not shown, through which the wrapped substrate covered with carbon paste is moved to effect drying.

Figure 19:
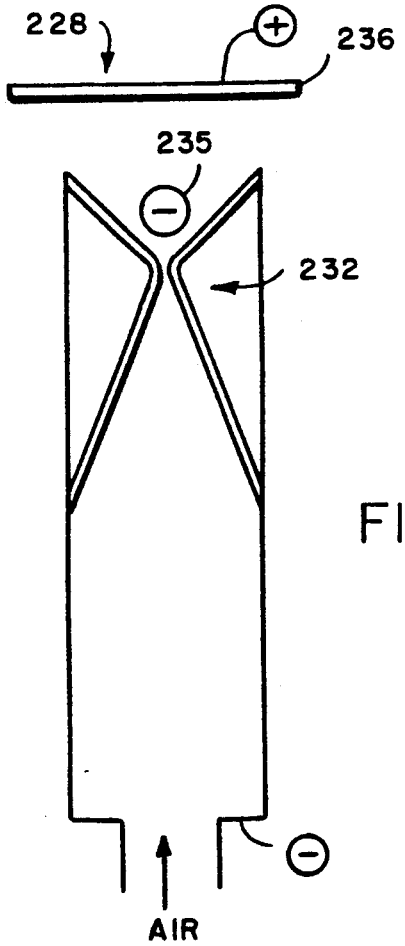
FIG. 19 diagrammatically illustrates dielectric heating means which can be used in making extruded cigarettes in accord with this invention.

Preferably, the means 130, 134 comprises inductive or dielectric heating means as illustrated in FIG. 19 which enables quick drying the layers of paste uniformly throughout their thickness. The inductive and dielectric heating means also enables removing the escaping water vapor without condensation on the surface and as diagrammatically illustrated in FIG. 19, comprises negative grate bars 232 through which air passes and positive heater plate 236. The coated structure 235 is partially supported by the air flow as it moves between the grate bars and heater plate.

The means 132 for extruding a layer of insulative paste is like that for extruding the layer of carbon paste.

As one preferred composite structure comprising the wrapped substrate, the layer of carbon paste and the layer of diatomaceous paste, emerges from the dryer 134, it is moved through a cooler not shown, and from thence through a wrapping device, not shown, for wrapping a paper strip circumferentially about the composite structure. The wrapping device can be, for example, similar to the device used to wrap the substrate, or it can be any conventional wrapping device.

The composite article made according to this invention, a diametrical section of which is illustrated in FIGS. 15 and 16, comprises a core 115, comprising an extruded tube of a substrate containing an aerosol generating material, a sleeve 117 of paper, a sleeve 119 of carbonaceous material, a sleeve 121 of diatomaceous material and a sleeve 123 of paper. The core 115, as shown in FIG. 15, may be formed with a single longitudinally-extending central passage 127. Alternatively, FIG. 16 shows the core 115 provided with a plurality of longitudinally-extending passages 129. The sleeve 117 is preferably comprised of low-density paper that is not permeable to air. Preferably, the sleeve 119 may be comprised of carbonized cotton or Kapok in a CMC binder.

The aerosol generating material of which the core 115 is formed preferably comprises a mixture of bentonite, hollow microspheres of insulative material such as glass or ceramic, and glycerine in a preferred amount of from about 25% to about 50% by weight in a CMC binder. Optionally, flavorants may also be included.

Desirably, a heat cured adhesive material is applied to the paper sleeve 117 to hold the sleeve together prior to coating with the carbonaceous sleeve 119.

The insulating material of which the sleeve 121 is formed may be comprised of diatomaceous materials in a CMC binder.

Figure 17:
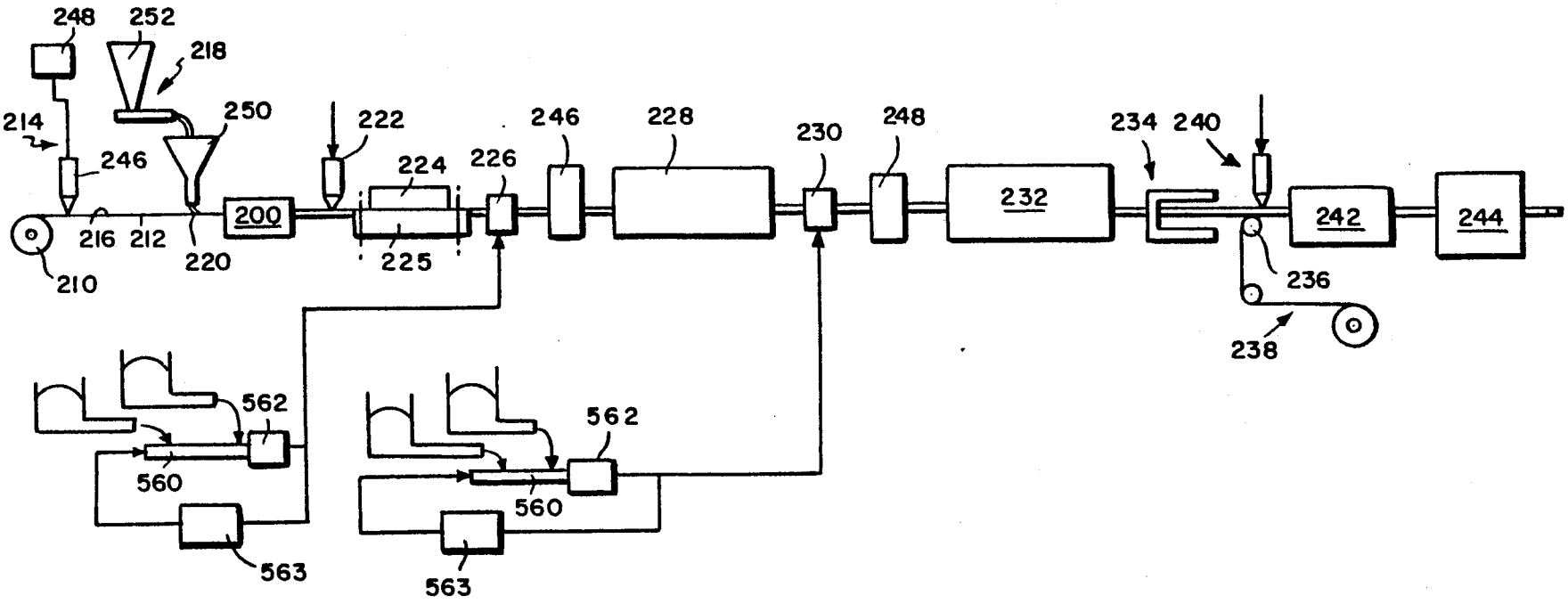
FIG. 17 diagrammatically illustrates an apparatus in an alternative form for making smoking articles according to this invention.

Alternatively, in FIG. 17, there is shown another embodiment of an apparatus for making smoking articles in accord with this invention. The apparatus comprises a support for delivering a narrow wrapper strip 212 of paper from a coil 210 of paper along a predetermined horizontal path; means 214 for depositing a layer of adhesive 216 on the paper strip 212; means 218 for depositing a particulate aerosol generating substrate 220 (e.g. alumina pellets) on the adhesive-coated paper strip 212; a garnature 200 for folding the paper strip 212 about the particulate substrate 220; means 222 for applying an adhesive to one of the marginal edges of the paper strip 212 as the strip leaves the garnature; means 224 for heat sealing the adhesive-coated edge to the other edge to seal the edges to each other; means 226 for extruding a layer of carbon paste about the substrate containing aerosol generating material; means 228 for drying the layer of carbon paste; means 230 extruding a layer of an insulative paste about the layer or carbon paste; and dryer means 232 for drying the layer of the insulative paste. Beyond the dryer means 232, there is a vortex cooler 234, means 236 for guiding a wrapper strip 238 from a coil thereof into tangential engagement with the wrapped substrate to which the layers of carbon paste and insulative paste have been applied to form a composite structure, means 240 for applying adhesive to the wrapper strip 238, means 242 for wrapping the wrapper strip 238 about the composite structure and moving the wrapped composite structure to means 244 for cutting the composite structure into predetermined lengths.

Conveyor means, not shown, are provided for aiding movement of the composite structure rectilinearly through the apparatus.

The paper strip 212 is drawn from a coil 210 of paper supported on a support for unwinding.

The means 214 for depositing adhesive on the paper strip 212 comprises a nozzle 246 supported above the strip 212 and a receptacle 248 for supplying glue to the nozzle.

The means 218 for depositing the substrate on the paper strip comprises a spreader 250 which is supplied with substrate from a feeder 252.

The garnature 200 comprises an elongate structure of channel-shaped section of a width to receive the paper strip 112 at its entrance end and to fold the opposite longitudinal edges upwardly and toward each other to receive the particulate substrate containing aerosol generating material. The garnature 200 comprises a folding device similar to that shown at 118 in FIGS. 12 and 13. The spreader 250 guides the particulate substrate onto the surface of the paper strip as it enters the garnature 200 for folding of the paper strip about the substrate. The garnature 200 wraps the opposite longitudinal edges of the paper strip upwardly about the substrate. As the partially folded paper strip with the substrate thereon emerges from the garnature, adhesive is applied to the underside of one of the marginal edges of the paper strip by the means 222 which is in the form of a nozzle supported beyond the garnature.

The heat-sealing means 224 for drying and sealing the lapped edges of the paper strip about the substrate comprises a housing through which the paper-wrapped substrate is moved. An endless roller chain 225 supports the wrapped substrate while it is moving through the heat sealing means 224.

The extruder means 226, FIG. 17, for extruding the carbon paste about the wrapped substrate comprises a pump 560 embodying a pump chamber 562 for receiving a quantity of carbon paste. The extruder means 226 is like the extruder 128 described above in connection with FIGS. 12 and 13, and has a die similar to die 159 as shown in FIG. 18.

The means 228 for drying the carbon paste desirably comprises dielectric or induction heating means like the means 130 and 134 referred to above which enables removing the water vapor from the paste.

The extruder means 230 for extruding the layer of insulative paste is like that for extruding the layer of carbon paste and, hence, need not be described further.

The means 232 for drying the layer of insulative paste is like the means 228 for drying the carbon paste.

As the composite structure comprising the wrapped substrate, the layer of carbon paste and the layer of insulative paste emerges from the dryer 232, it is moved through a cooler 234, e.g. a vortex cooler, or the like.

The wrapper strip 238, FIG. 17, is guided over the support 236 into tangential engagement with the composite structure, adhesive is applied by the nozzle 240 and the wrapping and pulling means 242 wraps the wrapper about the composite structure and advances it to the cutoff means 244.

Desirably, there is provided at the discharge side of the extruder 226 and the extruder 230, respectively, laser devices 246 and 248 for detecting the diameter of the carbon layer and the insulative layer and means operable in response thereto to increase or decrease the delivery of material from the respective extruders.

The substrate material 220 is an aerosol generating material preferably comprising aluminum pellets containing an aerosol forming material such as glycerol. The pellets are adhered to the paper strip with CMC before the paper strip is formed into a tube.

The carbon paste and the insulative paste are fed by Moyno 1FGJ3-SSQ pumps to the extruders 226 and 230. The laser devices 246 and 248 detect the extruded diameter and adjust the pump speeds to maintain the diameters at a set point.

The present invention will be further illustrated with reference to the following examples which aid in the understanding thereof, but which are not to be construed as limitations thereof. All percentages reported herein, unless otherwise specified, are percent by weight. All temperatures are expressed in degrees Celsius. Alumina, marumerized tobacco, and tobacco extracts were prepared as described in U.S. Pat. Nos. 4,756,318, 4,714,082 and 4,708,151.

EXAMPLE 1

Cotton linters were carbonized by heating under a nitrogen atmosphere at 650° C. for 2 hours. The carbonized cotton linters (90%) were mixed with sodium carboxymethyl cellulose (NaCMC, 10%) and sufficient water to made a formable putty. The fuel element was then produced by a low pressure molding or extrusion of the carbon/NaCMC putty. This low pressure technique produces a fuel element with a fibrous and porous structure which maintains easy ignition.

EXAMPLE 2

A mold cavity 7.1 mm O.D., 25 mm long, was machined from two brass pieces. When the two pieces were joined, a cavity the size and shape of a complete fuel element was formed. When the mold cavity was filled with the carbon/NaCMC putty of Example 1, a fuel element shaped like the mold cavity was produced. The carbon/NaCMC was dried within the mold.

Alternatively, the mold was lined with thin paper, such as cigarette rod paper, and once the carbon/-NaCMC had formed to shape, it was removed from the mold and dried while being retained by the paper.

EXAMPLE 3

Two cigarettes were formed by combining the following components:

carbon fuel—7.1 mm O.D.×25 mm formed from a paste in accord with Example 2 using long carbonized cotton linters (Example 1)

substrate tube—Aluminum or copper—3 mm O.D.×80 mm long (both types have been used)

substrate—(150 mg) of a 50/50 mix of marumerized tobacco and alumina with 23% glycerin mouthend piece—hollow wood tube—7.6 mm O.D.×10 mm long insulation—periphery of fuel and exposed tube (behind fuel) wrapped with fiberglass The substrate material use used to fill the substrate tube. The carbon fuel was molded around the lighting end of the substrate tube using a mold to form the fuel around the tube similar to Example 2. The hollow wood mouthend tube was attached to the mouth end of the substrate tube and the periphery of the cigarette was overwrapped with fiberglass tape. This cigarette was smoked on a smoking machine at a rate of one 35 cc puff per minute. The smoking results are tabulated below for cigarettes having copper tubes and for cigaretts having aluminum tubes.

| | Smoke Test - 35 cc puff - one per minute | | |
|---|---|---|---|
| Sample | WTPM (mg) | CO (mg) | $CO_2$ (mg) |
| Copper Tube | 21.9 | 6.6 | 28.9 |
| Aluminum Tube | 24.8 | 6.0 | 30.3 |

EXAMPLE 4

Bentonite (Albagel 4444 NFBC) 63% and glycerin 37% were mixed to form a very stiff putty-like paste. This mixture was extruded to form both tubular sections and triangular aerosol generating members, each about 70 to 80 mm in length and about 2 mm in diameter.

EXAMPLE 5

A mixture was made from bentonite (Albagel 4444 NFBC) 50 g, tobacco extract (a glycerin extract of flue cured spray dried extract) 32.5 g, and additional glycerine 11.0 g. This mixture was used to extrude a triangular prism-shaped substrate which was coated with the carbon fuel of Example 1, and machine smoked as shown below.

| Smoke Test - 35 cc puff - one per minute | | | |
|---|---|---|---|
| WTPM (mg) | CO (mg) | $CO_2$ (mg) | Puffs |
| 22.9 | 3.32 | 20.7 | 14 |

EXAMPLE 6

Aluminum wire 200×200 mesh, having an initial size of about 5/8 in. wide×60 mm long and containing 0.0021 in. diameter wire, was rolled into a spiral to form a substrate rod.

Two of these substrate rods were dipped into liquid glycerin heated to a temperature near its boiling point. One of the rods weighed 0.1003 g before dipping and 0.1820 g after dipping. Thus, 0.0817 g of glycerin was deposited on the aluminum spiral rod. The other spiral rod weighed 0.1251 g before dipping and 0.2542 g after. Thus, 0.1291 g of glycerin was deposited on the rod.

An appearance of liquid glycerin was not evident on the outside surfaces of the rods. However, when one end of the rod was heated with a propane flame, aerosol was produced which progressively moved down the rod as heat was transferred along its length.

Two cigarettes were made using this substrate. The marumerized tobacco/alumina substrate of Examples 3 was replaced with the above described glycerin impregnated rod. These cigarettes were machine smoked at one puff per minute at a 35-cc volume.

| | Smoke Tests | | | |
|---|---|---|---|---|
| | WTPM (mg) | CO | $CO_2$ | Puffs |
| Cigarette 1 | 34.5 | 0.79 | 7.6 | 5 |
| Cigarette 2 | 24.3 | 0.83 | 7.6 | 5 |

EXAMPLE 7

Aluminum foil 0.00025 in. thick was shredded at 32 cuts/inch. The shreds were then twisted into strands about 0.075" diameter to be used as substrates for the were dipped into hot glycerin (near the boiling point). Two sections of the twisted strands, each about 60 mm long, were weighed.

| | Wt. Before Dipping | Wt. After Dipping | Wt. of Glycerin |
|---|---|---|---|
| #1 | 0.0253 g | 0.1598 g | 0.1345 g |
| #2 | 0.0385 g | 0.1462 g | 0.1077 g |

EXAMPLE 8

Aluminum pellets were made from 0.00025 in. thick foil by wrapping the foil into a cylinder. Sections about 1/16" long were then cut into pellets to be used as substrates for the cigarettes of the present invention. The aluminum pellets were impregnated with 25% (by wt.) glycerin.

Cigarettes were prepared using these substrates as follows:

The aluminum substrate tubes in Example 3 were filled with a 50/50 mixture of V-040 glass beads and the impregnated aluminum pellets. Smoke tests were made at one puff per minute of 35-cc volume.

| Sample | WTPM (mg) | Smoke Test CO (mg) | $CO_2$ (mg) | Puffs |
|---|---|---|---|---|
| 1 | 13 | 17.0 | 1.0 | 13.9 |
| 2 | 13 | 21.7 | 1.3 | 14.6 |

EXAMPLE 9

Aluminum pellets were made by folding a 0.00025 in. thick×4 in. wide piece of aluminum foil until it was about 1/8 in. wide. The foil was then pulled through a series of orifices of decreasing diameter until the foil was round and had a O.D. of about 0.060 in. and then it was chopped into rod-like pellets and sieved. The −10, +14 mesh particles were retained.

EXAMPLE 10

A series of cigarettes were prepared using the pellets described in Example 9 in the cigarette described in Example 6 as follows:

| | |
|---|---|
| Sample A | 200 mg of substrate pellets/device, containing 7% spray-dried water extract of flue cured tobacco, 18% glycerin, 75% aluminum substrate pellets. |
| Sample B | 200 mg of substrate pellets/device, containing 7% spray-dried water extract of flue cured tobacco, 18% propylene glycol, 75% aluminum substrate pellets. |
| Sample C | 200 mg of substrate pellets/device, containing 18% glycerin, 82% aluminum substrate pellets |
| Sample D | 200 mg of substrate pellets/device, containing 18% propylene glycol, 82% aluminum substrate pellets |
| Sample E | 200 mg of substrate pellets/device, containing 18% glycerin, 5% alcohol extract of spray-dried water extract of flue cured tobacco, 77% aluminum substrate pellets |

Smoke tests were conducted on four of these sets of cigarettes wherein groups of five cigarettes were machine smoked at a 35-cc puff volume, one puff/minute. The results of these smoking tests are reported below.

| Puffs | WTPM | Nicotine | Glycerin | Water | CO | $CO_2$ |
|---|---|---|---|---|---|---|
| SMOKE TESTS | | | | | | |
| Sample A: | | | | | | |
| 10.6 | 21.9 mg | 0.467 mg | 12.702 mg | 5.307 mg | 1.34 mg | 16.28 mg |
| Sample B: | | | | | | |
| 10.4 | 20.38 mg | 0.317 mg | 11.034 mg | 4.170 mg | 1.27 mg | 16.36 mg |
| Sample C: | | | | | | |
| 10.8 | 19.84 mg | 0.000 mg | 12.900 mg | 2.947 mg | 0.75 mg | 10.07 mg |
| Sample E: | | | | | | |
| 10 | 20.28 mg | 0.670 mg | 11.688 mg | 4.399 mg | 1.03 mg | 11.41 mg |

EXAMPLE 11

A cigarette substantially the same as that illustrated in FIG. 1 was prepared from the following components:

mouthend piece—10 mm long/8 mm diameter hollow plastic tube insulation—60 mm×7.5–8.0 mm O.D. admixture of Celite 560 (93%) and xanthan gum (7%)

carbon fuel—60 mm×7.1 mm O.D. kapok carbon (90%) and xanthan gum (10%)

substrate tube—60 mm×3.3 mm O.D. Archer 8-0551-93 paper with nitro-cellulose lip release; coated with colloidal silica #830 (90%) and precipitated calcium carbonate (10%)

substrate—263 mg particulate alumina with 23% glycerin (See Example 8)

outer paper—KC P1768-83-24 burn barrier—20 mm segment of KC P1224-30-2 paper (a) The fuel ingredients were admixed with sufficient water to form an extrudable or moldable mass having a putty- or paste-like consistency.

(b) The substrate container (tube) was formed from the recited paper, coated with an aqueous solution of burn retarding agents. This paper (after drying) was formed into a tube around the aerosol generating substances (alumina coated with glycerin).

(c) The fuel mass was molded around the coated paper tube and dried. The combined fuel/aerosol generator member was coated with an aqueous paste of the insulating material by molding to a final outer diameter of from about 7.5 mm to about 8.0 mm. This material was dried and the insulated front end was attached to the mouthend piece by means of the burn barrier paper segment.

(d) The periphery of the article, up to the mouthend piece was then overwrapped with the outer paper for appearance, air permeation control and structural stability.

| Smoke Tests - 35 cc puff - one per minute | | |
|---|---|---|
| WTPM (mg) | CO (mg) | Puffs |
| 15.9 | 3.3 | 12 |

EXAMPLE 12

A cigarette substantially the same as that illustrated in FIG. 3 was prepared from the following components:

mouthend piece—25 mm long/8 mm diameter hollow plastic tube insulation—55 mm×7.5–8.0 mm O.D. carbonized cotton linters (10%), cellulose fibers (10%), calcium carbonate 30–50 (48%), NaCMC (2%), calcium sulphate A-30 (10%), hydrated alumina (20%)

carbon fuel—55 mm×7.1 mm O.D. carbonized cotton linters (50%), cellulose fibers (20%), calcium carbonate 30–50 (25%), NaCMC (5%)

substrate tube—55 mm×3.3 mm O.D. Archer PD5427-5-22-87 paper with nitrocellulose coating both sides substrate—263 mg alumina with spray dried tobacco extract outer paper—KC P1768-83-24 burn barrier 20 mm segment of KC P1224-30-2 paper (a) The fuel ingredients were admixed with sufficient water to form an extrudable or moldable mass having a putty- or paste-like consistency.

(b) The substrate container (tube) was formed from the recited paper, coated with an aqueous solution of the recited burn retarding agents. This paper (after drying) was formed into a tube around the aerosol generating substances (the treated alumina).

(c) The fuel mass was molded around the coated paper tube and dried. The combined fuel/aerosol generator member was coated with an aqueous paste of the insulating material by molding. This material was dried and the insulated front end was attached to the mouthend piece by means of the burn barrier paper segment.

(d) The periphery of the article, up to the mouthend piece was then overwrapped with the outer paper for appearance, air permeation control and stability.

EXAMPLE 13

A cigarette substantially the same as that illustrated in FIG. 4 was prepared from the following components:

mouthend piece—20 mm long/8 mm diameter hollow plastic tube outer insulation—55 mm×7.5-8.0 mm O.D. calcium sulphate fiber A-30 (15%), cellulose fiber, (7%), cotton linter carbon (7%), calcium carbonate 30-50 (55%), precipitated calcium carbonate (15%) and NaCMC (1%)

inner insulation—35 mm×7.0 mm O.D. calcium sulphate fiber A30 (15%), cellulose fiber (19%), cotton linter carbon (20%), calcium carbonate 30-50 (35%), precipitate calcium carbonate (10%) and NaCMC (1%)

carbon fuel—55 mm×6.0 mm O.D. cotton linter carbon (50%), cellulose fiber (10%), calcium carbonate 30-50 (35%) and NaCMC (5%)

substrate tube—55 mm×3.3 mm O.D. Archer tipping paper coated both sides with nitrocellulose & colloidal silica both sides, precipitated calcium carbonate one side substrate—324 mg alumina having tobacco extract (7%) and glycerin (18%)

outer paper—KC P1768-83-24 burn barrier—same as Example 12

(a) The fuel ingredients were admixed with sufficient water to form an extrudable or moldable mass having a putty- or paste-like consistency.

(b) The substrate container (tube) was formed from the recited paper, coated with an aqueous solution of the recited burn retarding agents. This paper (after drying) was formed into a tube around the aerosol generating substances (the treated alumina).

(c) The fuel mass was molded around the coated paper tube and dried. The combined fuel/aerosol generator member was coated with an aqueous paste of the first (inner) insulating mixture by molding. This material was dried and then coated with the outer insulating mixture. The insulated front end was attached to the mouthend piece by means of the burn barrier paper segment.

(d) The periphery of the article, up to the mouthend piece was then overwrapped with the outer paper for appearance, air permeation control and stability.

EXAMPLE 14

A cigarette substantially the same as that illustrated in FIG. 5 was prepared from the following components:

mouthend piece—25 mm long/paper tube insulation—admixed with fuel carbon fuel—carbonized cotton linters (23%), tobacco powder (15%), calcium carbonate 30-50 (55%), hydrated alumina (4%) NaCMC (3%)

substrate tube—0.130" diameter—Archer 5522 paper coated with colloidal silica 2050 and calcium carbonate substrate—aluminum pellets −14-+16 mesh (23%) glycerin outer paper—KC P1224-30-2 (permeability 0)

burn barrier—same as Example 12

(a) The fuel and insulating ingredients were admixed with sufficient water to form an extrudable or moldable mass having a putty- or paste-like consistency.

(b) The substrate container (tube) was formed from the recited paper, coated with an aqueous solution of the recited burn retarding agents. This paper (after drying) was formed into a tube around the aerosol generating substances (the treated alumina).

(c) The fuel insulating mass was molded around the coated paper tube and dried. The insulated front end was attached to the mouthend piece by means of the burn barrier paper segment.

(d) The periphery of the article, up to the mouthend piece was then overwrapped with the outer paper for appearance, air permeation control and stability.

| Smoke Tests - 35 cc puff - one per minute | | | |
|---|---|---|---|
| WTPM (mg) | CO (mg) | $CO_2$ (mg) | Puffs |
| 12 | 5.1 | 27.6 | 23.1 |
| 12 | 5.9 | 28.1 | 21.7 |

EXAMPLE 15

A cigarette substantially the same as that illustrated in FIG. 6 was prepared from the following components:

mouthend piece—25 mm long/paper tube insulation—admixed with fuel carbon fuel—same as Example 14 substrate tube—same as Example 14 substrate—aluminum pellets—300 mg with 23% glycerin outer paper—KC's 0 permeability paper (Example 14)

burn barrier—same as Example 12

(a) The fuel and insulating ingredients were admixed with sufficient water to form an extrudable or moldable mass having a putty- or paste-like consistency.

(b) The substrate container (tube) was formed from the recited paper, coated with an aqueous solution of the recited burn retarding agents. This paper (after drying) was formed into a tube around the aerosol generating substances (the treated alumina).

(c) The fuel/insulating mass was molded around the coated paper tube and dried. The insulated front end was attached to the mouthend piece by means of the burn barrier paper segment.

(d) The periphery of the article, up to the mouthend piece was then overwrapped with the outer paper for appearance, air permeation control and stability.

EXAMPLE 16

A cigarette was prepared from the following components:

mouthend piece—27 mm long/paper tube insulation—none fuel—57 mm long tobacco rod substrate tube—3.0 mm (0.120") O.D. KC P780-63-5—coated both sides with colloidal silica (Nya Col 830).
substrate—paste extrusion to fill tube from a mixture of 2.46 g of bentonite and 2.74 g of glycerin
outer paper—same as Example 15
burn barrier'1 mm sodium silicate & bentonite (a) A tobacco rod from a NOW cigarette was hollowed out by inserting a 3.0 mm O.D. metal rod therethrough.

(b) The aerosol forming ingredients were admixed into an extrudable mass having a putty- or paste-like consistency. This mass was extruded as a continuous column about 3.0 mm in diameter.

(c) The substrate container (tube) was formed from the recited paper, coated with an aqueous solution of the recited burn retarding agents. This paper (after drying) was formed into a tube around the extruded column of aerosol forming substances.

(d) The filled substrate tube was inserted into the tobacco fuel rod.

(e) The periphery of the article, up to the mouthend piece was then overwrapped with the outer paper for appearance, air permeation control and stability.

| | Smoke Tests - 35 cc puff - one per minute | | | | |
|---|---|---|---|---|---|
| Sample | WTPM (mg) | CO (mg) | $CO_2$ (mg) | Puffs | Substrate Wt. (mg) |
| 1 | 11.6 | 3.1 | 13.7 | 10 | 180 |
| 2 | 12.0 | 2.7 | 13.5 | 11 | 178 |
| 3 | 8.8 | 1.7 | 11.5 | 11 | 193 |
| 4 | 6.1 | 1.3 | 9.9 | 11 | 200 |

EXAMPLE 17

A cigarette was prepared from the following components:
mouthend piece—27 mm long/paper tube
insulation—none
fuel—same as Example 16
substrate tube—KC AT-N tobacco paper sheet, coated with Nya Col 830 colloidal silica
substrate—1.98 mg of bentonite and glycerin paste
outer paper—KC P1224-30-2 (permeability 0)
burn barrier—bentonite & sodium silicate (a) A tobacco rod from a NOW cigarette was hollowed out by inserting a 3.0 mm O.D. metal rod therethrough.

(b) The aerosol forming ingredients were admixed into an extrudable mass having a putty- or paste-like consistency. This mass was extruded as a continuous column about 3.0 mm in diameter.

(c) The substrate container (tube) was formed from the recited paper, coated with an aqueous solution of the recited burn retarding agents. This paper (after drying) was formed into a tube around the extruded column of aerosol forming substances.

(d) The filled substrate tube was inserted into the tobacco fuel rod.

(e) The periphery of the article, up to the mouthend piece was then overwrapped with the outer paper for appearance, air permeation control and stability.

| Smoke Tests - 35 cc puff - one per minute | | | |
|---|---|---|---|
| WTPM (mg) | CO (mg) | $CO_2$ (mg) | Puffs |
| 11.7 | 2.4 | 14.7 | 13 |

EXAMPLE 18

A cigarette substantially the same as that illustrated in FIG. 9 was prepared from the following components:
mouthend piece—15 mm long/paper tube
insulation—35 mm long×7.5 mm O.D. celite 560 (93%)—NaCMC (10%)
carbon fuel—35 mm long×5.15 mm cotton carbon (0.203") O.D.
substrate tube—P1487-31 paper, 35 mm×2.9 mm (0.115" O.D. coated with Nya Col 830 colloidal silica
substrate—Bentonite (albagel 4444 NFBC) 63% and glycerin (37%)
outer paper—P 780-63-5
burn barrier—bentonite & sodium silicate (a) The fuel ingredients were admixed with sufficient water to form an extrudable mass having a putty- or paste-like consistency.

(b) The aerosol forming ingredients were admixed into an extrudable mass having a putty- or paste-like consistency. This mass was extruded as a continuous column about 2.9 mm in diameter.

(c) The substrate container (tube) was formed from the recited paper, previously coated with an aqueous solution of the recited burn retarding agents. This paper (after drying) was formed into a tube around the extruded column of aerosol forming substances.

(d) The fuel mass was extruded so as to surround the paper tube. The thus coextruded fuel/aerosol generator column was then dried and cut to a suitable length. The combined fuel/aerosol generator member was thereafter coated with an aqueous paste of the insulating material. This material was dried and the insulated front end was attached to the mouthend piece by means of the burn barrier paper segment.

(e) The periphery of the article, up to the mouthend piece was then overwrapped with the outer paper for appearance, air permeation control and stability.

| Smoke Tests - 35 cc puff - one per minute | | | |
|---|---|---|---|
| WTPM (mg) | CO (mg) | $CO_2$ (mg) | Puffs |
| 21.0 | 4.2 | 24.2 | 13 |

EXAMPLE 19

A cigarette substantially the same as that illustrated in FIG. 10 was prepared from the following components:
mouthend piece—15 mm long/paper tube
insulation—35 mm×7.5 mm O.D. celite 560 NaCMC (10%)
carbon fuel—35 mm long×6.35 mm (0.250") O.D. cotton carbon
substrate tube—35 mm long stainless steel tube (0.0005" wall×0.115" O.D.)
substrate—same as Example 18
outer paper—P780-63-5
burn barrier—bentonite & sodium silicate (a) The fuel ingredients were admixed with sufficient water to form an extrudable mass having a putty- or paste-like consistency.

(b) The aerosol forming ingredients were admixed into an extrudable mass having a putty- or paste-like consistency.

(c) The substrate tube was filled with the putty-like substrate mixture.

(d) The fuel mass was molded around the metal tube. The fuel was then dried and the combined fuel/aerosol generator member was thereafter coated with an aqueous paste of the insulating material. This material was dried and the insulated front end was attached to the mouthend piece by means of the burn barrier paper segment.

(e) The periphery of the article, up to the mouthend piece was then overwrapped with the outer paper for appearance, air permeation control and stability.

| Smoke Tests - 35 cc puff - one per minute | | | |
|---|---|---|---|
| WTPM (mg) | CO (mg) | $CO_2$ (mg) | Puffs |
| 47.8 | 2.61 | 15.0 | 13 |

EXAMPLE 20

A cigarette substantially the same as that illustrated in FIG. 9 was prepared from the following components:

mouthend piece—15 mm long/paper tube insulation—35 mm×7.5 mm O.D. celite 560 NaCMC (10%)

carbon fuel—100% cotton carbon 35 mm×6.35 mm (0.250") O.D.

substrate tube—35 mm long stainless steel tube (0.0005" wall×0.115" O.D.)

substrate—35 mm extruded substrate—triangular prism (max. diameter about 2.9 mm)

outer paper—P 780-63-5 burn barrier—bentonite and sodium silicate (50/50)

(a) The fuel ingredients were admixed with sufficient water to form an extrudable mass having a putty- or paste-like consistency.

(b) The aerosol forming ingredients were admixed into an extrudable mass having a putty- or paste-like (c) The substrate tube was filled with the putty-like substrate mixture.

(d) The fuel mass was molded around the metal tube. The fuel was then dried and the combined fuel/aerosol generator member was thereafter coated with an aqueous paste of the insulating material. This material was dried and the insulated front end was attached to the mouthend piece by means of the burn barrier paper segment.

(e) The periphery of the article, up to the mouthend piece was then overwrapped with the outer paper for appearance, air permeation control and stability.

| Smoke Tests - 35 cc puff - one per minute | | | |
|---|---|---|---|
| WTPM (mg) | CO (mg) | $CO_2$ (mg) | Puffs |
| 33.3 | 2.19 | 13.3 | 13 |

EXAMPLE 21

A cigarette substantially the same as that illustrated in FIG. 10 was prepared from the following components:

mouthend piece—15 mm long/ paper tube insulation—35 mm×7.5 mm O.D. celite 560—10% NaCMC carbon fuel—35 mm long cotton carbon (90%) (10% NaCMC) 6.35 mm (0.250") O.D.

substrate tube—35 mm long stainless steel tube—0.0005" thick wall×0.115" O.D.

substrate—35 mm long×2.9 mm O.D. extruded tube of bentonite (albagel 4444 NFBC) 50 g, tobacco extract (glycerin extract of CAG spray dried extract) 32.5 g and glycerin 11.0 g outer paper—P780-63-5 burn barrier—sodium silicate and bentonite (a) The fuel ingredients were admixed with sufficient water to form an extrudable mass having a putty- or paste-like consistency.

(b) The aerosol forming ingredients were admixed into an extrudable mass having a putty- or paste-like consistency.

(c) The substrate tube was filled with the putty-like substrate mixture.

(d) The fuel mass was molded around the metal tube. The fuel was then dried and the combined fuel/aerosol generator member was thereafter coated with an aqueous paste of the insulating material. This material was dried and the insulated front end was attached to the mouthend piece by means of the burn barrier paper segment.

(e) The periphery of the article, up to the mouthend piece was then overwrapped with the outer paper for appearance, air permeation control and stability.

| Smoke Tests - 35 cc puff - one per minute | | | |
|---|---|---|---|
| WTPM (mg) | CO (mg) | $CO_2$ (mg) | Puffs |
| 22.9 | 3.32 | 20.7 | 14 |

EXAMPLE 22

A cigarette substantially the same as that illustrated in FIG. 11 was prepared from the following components:

mouthend piece—15 mm long paper tube insulation—25 mm long diatomaceous earth—celite 560 (70%) and 6437 chopped fiber glass (25%) NaCMC (5%)

carbon fuel—25 mm long, 6.35 mm (0.250") O.D. cotton carbon (90%) and NaCMC (10%)

substrate tube—0.005" thick wall stainless steel tube—30 mm long substrate—30 length Hercules magnatite graphite fiber impregnated with 0.04 g glycerin outer paper—P850-192-2 burn barrier—bentonite and sodium silicate (a) The fuel ingredients were admixed with sufficient water to form an extrudable mass having a putty- or paste-like consistency.

(b) The aerosol forming ingredients were admixed into an extrudable mass having a putty- or paste-like consistency.

(c) The substrate tube was filled with the putty-like substrate mixture.

(d) The fuel mass was molded around the metal tube. The fuel was then dried and the combined fuel/aerosol generator member was thereafter coated (e) The periphery of the article, up to the mouthend piece was then overwrapped with the outer paper for appearance, air permeation control and stability.

| Smoke Tests - 35 cc puff - one per minute | | | |
|---|---|---|---|
| WTPM (mg) | CO (mg) | $CO_2$ (mg) | Puffs |
| 24.4 | .98 | 11.4 | 14 |

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A smoking article comprising:

(a) an aerosol generating means comprising an extruded composition containing a substrate material and at least one aerosol forming substance;

(b) a non-metallic barrier member encircling the aerosol generating means, which substantially precludes fluid flow radially therethrough and which is disposable as the article burns back;

(c) an extruded carbonaceous fuel element encircling the barrier member; and (d) tobacco located in a substantially non-combustible arrangement with respect to the fuel element so that substantially no combustion products of tobacco will be formed during use.

2. The smoking article of claim 1, which further comprises an insulating member encircling the fuel element.

3. The smoking article of claim 1, wherein tobacco is located in the aerosol generating means.

4. The smoking article of claim 1, wherein the aerosol forming substance includes a tobacco extract.

5. The smoking article of claim 1, wherein the aerosol generating means comprises an admixture of a clay and a polyhydric alcohol.

6. The smoking article of claim 1, 2, 3, 4 or 5, wherein the aerosol generating means comprises an admixture of bentonite clay and glycerin.

7. The smoking article of claim 1, 2, 3, 4 or 5, wherein the aerosol generating means is an homogenous mass comprising a mixture of substrate material and an aerosol forming substance.

8. The smoking article of claim 1, wherein the barrier member permits sufficient heat transfer to heat the tobacco to a temperature that does not exceed 500° C. during smoking.

9. The smoking article of claim 1, wherein the barrier member permits sufficient heat transfer to heat the tobacco to a temperature in the range of from about 250° C. to about 400° C. during smoking.

10. The smoking article of claim 1, wherein said tubular barrier member comprises paper treated with a burn retarding agent.

11. The smoking article of claim 10, wherein said burn retarding agent is colloidal silica, alum, or an inorganic chloride salt.

12. A cigarette comprising an extruded carbonaceous fuel element, an insulating member encircling the fuel element along the longitudinal length thereof, and tobacco encircling the insulating member along at least a portion of its longitudinal length, the insulating member preventing heating of the tobacco to a temperature greater than about 500° C. during smoking.

13. The cigarette of claim 12, wherein the insulating member permits heating the tobacco to a temperature in the range of from about 250° C. to about 400° C. during smoking.

14. The cigarette of claim 12 or 13, further comprising a barrier member which substantially precludes fluid flow between the fuel element and the tobacco material.

15. A cigarette comprising a roll of tobacco containing material, an insulating member encircling the tobacco roll along the longitudinal length thereof, and a carbonaceous fuel element encircling the insulating member along the longitudinal length thereof, the insulating member having a composition and thickness sufficient to prevent heating the tobacco to a temperature greater than about 500° C. during smoking.

16. The cigarette of claim 15, wherein the insulating member permits heating the tobacco to a temperature in the range of from about 250° C. to about 400° C. during smoking.

17. The cigarette of claim 15 or 16, further comprising a tubular barrier member which substantially precludes fluid flow radially therethrough.

18. A smoking article comprising:

(a) an aerosol generating means comprising an extruded substrate material having associated therewith at least one aerosol forming substance;

(b) a barrier member encircling the aerosol generating means, which substantially precludes radial fluid flow therethrough;

(c) an extruded carbonaceous fuel element encircling the barrier member; and (d) an insulating member encircling the fuel element.

19. The smoking article of claim 18, further comprising a mouthend piece.

20. The smoking article of claim 19, further comprising a spacer member between the fuel element and the mouthend piece.

21. The smoking article of claim 20, wherein spacer member comprises tobacco.

22. An article of manufacture useful for making cigarettes, the article of manufacture comprising:

(a) an aerosol generating means comprising an extruded composition containing a substrate material bearing an aerosol forming substance;

(b) an extruded carbonaceous fuel element; and (c) a non-metallic barrier member separating the aerosol element to substantially preclude fluid flow therebetween, the barrier member being disposable as the article burns back.

23. The article of claim 22, further comprising tobacco.

24. The article of claim 22, further comprising an insulating member encircling the fuel element.

25. The article of claim 22, wherein the aerosol generating means comprises tobacco material.

26. The article of claim 22, wherein the aerosol forming substance includes a tobacco extract.

27. The article of claim 22, wherein the aerosol generating means comprises an admixture of a clay and a polyhydric alcohol.

28. The article of claim 22, 23, 24, 25, 26 and 27, wherein the aerosol generating means comprises an admixture of bentonite clay and glycerin.

29. The article of claim 22, 23, 24, 25, 26 and 27, wherein the aerosol generating means is an homogenous mass comprising a mixture of substrate material and an aerosol forming substance.

30. The article of claim 22, wherein the barrier member permits sufficient heat transfer to heat the tobacco to a temperature that does not exceed 500° C. during smoking.

31. The article of claim 22, wherein the barrier member permits sufficient heat transfer to heat the tobacco to a temperature in the range of from about 250° C. to about 400° C. during smoking.

32. The article of claim 22, wherein said tubular barrier member comprises paper treated with a burn retarding agent.

33. The article of claim 32, wherein said burn retarding agent is colloidal silica, alum, or an inorganic chloride salt.

34. A process for making a cigarette, which comprises:

(a) forming an aerosol generating means comprising a substrate material and at least one aerosol forming substance into a longitudinal structure, the structure permitting air and aerosol flow longitudinally therethrough;

(b) extruding a layer of carbonaceous material around at least a portion of the longitudinal periphery of the aerosol generating means to form a composite structure; and (c) cutting the composite structure into predetermined lengths.

35. The process of claim 34, further comprising forming a barrier member around the longitudinal periphery of the aerosol generating means prior to extruding the layer of carbonaceous material.

36. The process of claim 34, further comprising forming an insulating member around the longitudinal periphery of the carbonaceous material.

37. The process of claim 34 wherein the step of forming the aerosol generating means further comprises extruding a mass comprising an homogeneous mixture of the substrate and an aerosol forming substance to form the longitudinal structure.

38. The process of claim 37, further comprising drying the extruded longitudinal structure.

39. The process of claim 34, wherein step (b) further comprises:

providing a paste containing the carbonaceous material;

feeding the longitudinal structure through an extrusion die;

extruding a layer of the paste around the aerosol generating means; and drying the paste to form the composite structure having a carbonaceous fuel element.

40. The process of claim 39, further comprising forming an insulating member around the longitudinal periphery of the carbonaceous fuel element.

41. The process of claim 40, further comprising drying the insulating member.

42. The process of claim 34, further comprising drying the layer of carbonaceous material to form a carbonaceous fuel element.

43. The process of claim 34, 35, 37, 38 or 42, further comprising extruding a layer of insulating material around the layer of carbonaceous fuel.

44. A method for making a smoking article comprising forming an elongate structure comprising a substrate having an aerosol forming material, extruding a layer comprising carbonaceous material circumferentially around the elongate structure, and extruding a layer comprising insulative material circumferentially around the carbonaceous material layer.

45. The method of claim 44, further comprising drying the carbonaceous material layer to form a carbonaceous fuel element.

46. The method according to claim 44, further comprising wrapping a paper strip about the elongate structure.

47. The method according to claim 44 or 45, further comprising drying the elongate structure prior to extruding the carbonaceous material.

48. A method of making a smoking article, the method comprising extruding an elongate cylindrical core comprising aerosol forming material, the core having at least one internal longitudinal passage, extruding a layer comprising carbonaceous material circumferentially around the core, and extruding a layer comprising insulative material around the carbonaceous material layer.

49. A method for making a smoking article comprising extruding an elongate member comprising aerosol forming material, wrapping the extruded tube of aerosol forming material with a sleeve of paper, extruding a layer comprising carbonaceous material about the paper-wrapped tube, and extruding a layer comprising insulative material about the layer of carbonaceous material.

50. The method of claim 49, wherein the elongate member has a circular cross section.

51. The method of claim 48, further comprising forming a barrier member between the aerosol forming material and the carbonaceous material to substantially prevent fluid flow therebetween.

52. The method according to claim 49, further comprising wrapping the layer of insulative material with a paper wrapper.

53. Apparatus for making a smoking article comprising:

means for supporting and moving a strip of sheet material along a predetermined path;

means for depositing on the strip of sheet material a composition comprising an aerosol forming material and a substrate for movement with the sheet material as it is moved along said path;

means for wrapping the sheet material about the ) composition to form a tubular member around the composition; and means for extruding a layer containing carbonaceous material around the tubular member.

54. The apparatus of claim 53 further comprising means for extruding a layer of insulative material around the layer of carbonaceous material.

55. Apparatus according to claim 53 or 54, further comprising means for wrapping the smoking article with a wrapper material.

56. Apparatus according to claim 53, further comprising means for drying the composition after wrapping the composition in the strip of sheet material.

57. Apparatus according to claim 53, further comprising means for drying the extruded layer to form a carbonaceous fuel.

58. The apparatus of claim 54, further comprising means for drying the extruded insulative material.

59. Apparatus according to claim 58, further comprising means for drying the extruded layer to form a carbonaceous fuel.

60. Apparatus according to claim 53 wherein the means for extruding the layer of insulative material further comprises means for feeding the tubular member having the layer of carbonaceous material through an extrusion die, and means for injecting the insulative material into the die to form an insulating layer about the carbonaceous material.

61. Apparatus according to claim 53 wherein the means for depositing the aerosol generating composition on the strip of sheet material further comprises means for extruding the composition to form a longitudinal structure having one or more interior longitudinal passages.

* * * * *